United States Patent [19]

Hartle

[11] Patent Number: 4,598,871

[45] Date of Patent: Jul. 8, 1986

[54] MULTIPLE PROCESS ELECTROSTATIC SPRAY GUN HAVING INTEGRAL POWER SUPPLY

[75] Inventor: Ronald J. Hartle, Lorain, Ohio

[73] Assignee: Nordson Corporation, Amherst, Ohio

[21] Appl. No.: 608,882

[22] Filed: May 10, 1984

[51] Int. Cl.[4] ..... B05B 5/02

[52] U.S. Cl. ..... 239/706; 239/390

[58] Field of Search ..... 239/690, 691, 704–708, 239/390, 391, 600, 525, 695, 396, 526

[56] References Cited

U.S. PATENT DOCUMENTS

| | | | |
|---|---|---|---|
| 3,608,823 | 9/1971 | Buschor | 239/706 X |
| 3,731,145 | 5/1973 | Senay . | |
| 3,747,850 | 7/1973 | Hastings et al. . | |
| 4,171,098 | 10/1979 | Braun | 239/708 |
| 4,241,880 | 12/1980 | Hastings . | |
| 4,287,552 | 9/1981 | Wagner et al. | 239/708 X |
| 4,331,298 | 5/1982 | Bentley et al. | 239/690 |
| 4,380,320 | 4/1983 | Hollstein et al. . | |
| 4,483,483 | 11/1984 | Grime | 239/526 |

FOREIGN PATENT DOCUMENTS 3126936 2/1983 Fed. Rep. of Germany .

OTHER PUBLICATIONS

Translation of German Specification "Electrostatic Spray Gun"; Roll No. G 81-19, 946.5; 9-9-1982.

*Primary Examiner*—Joseph F. Peters, Jr.
*Assistant Examiner*—Daniel R. Edelbrock
*Attorney, Agent, or Firm*—Wood, Herron & Evans

[57] ABSTRACT

An improved electrostatic spray gun wherein the power pack for transforming a low voltage electrical signal from an external source to a high voltage signal for application to the gun electrode is wholly contained within the handle of the gun. The gun includes multiple interchangeable barrels for enabling the gun to spray airless atomized liquids, or air spray atomized liquid, or air-entrained solid particulate materials.

4 Claims, 10 Drawing Figures

MULTIPLE PROCESS ELECTROSTATIC SPRAY GUN HAVING INTEGRAL POWER SUPPLY

This invention relates to electrostatic spray coating systems, and more particularly to an improved electrostatic spray gun for use in such systems.

Electrostatic spray coating systems of the general type to which this invention relates typically include as a principal component thereof an electrostatic spray gun. The gun has a handle designed to be manually grasped by the operator and a barrel which at its forward end terminates in a nozzle. A spray of coating material, which may be in the form of an atomized liquid or an air-entrained solid powder, flows from the gun nozzle toward the object being coated when an actuator of the handle, such as a trigger, is actuated by the operator. An electrode, electrically insulated from the gun handle, trigger, and barrel, is mounted in the nozzle and is maintained at a high DC potential, e.g., 76 kv, for electrostatically charging the coating particles as they leave the nozzle. Electrostatic charging of the particles enhances, for well-known reasons, the deposition of the coating on the article being coated, which is typically maintained at ground potential.

Electrostatic spray systems typically include a power pack or booster supply for transforming low voltage power to a high DC voltage which is then applied to the gun electrode for electrostatically charging the coating particles as they emerge from the gun. According to the disclosure of U.S. Pat. No. 3,731,145 of Robert S. Senay, this power pack may be contained wholly within the gun so as to eliminate the need for a heavy high voltage cable to interconnect the power pack and the gun. According to the disclosure of this Senay patent, which patent is assigned to the assignee of this application, the power pack comprises a transformer which is mounted in the handle section of the gun and a voltage multiplier contained within the barrel section of the gun.

One characteristic of all electrostatic spray guns which have heretofore incorporated a power pack into the gun is that such guns incorporate a substantial portion of the power pack in the barrel end of the gun. As so located, the gun is difficult for an operator to utilize for a long period of time without suffering arm fatigue as a result of handling that relatively large weight at the end of the barrel displaced from the handle of the gun.

It has therefore been our objective of this invention to provide an improved electrostatic spray gun wherein the operator suffers less fatigue and may maneuver the gun more easily than has heretofore been possible with guns which have heretofore incorporated the power pack into the gun.

According to the practice of this aspect of the invention, the complete power pack of the gun is located within the handle section of the gun.

Electrostatic spray guns having the power pack contained within the gun have in the past been used to electrostatically spray air atomized liquid coating materials as well as airless atomized liquid coating materials and air-entrained solid particulate coating materials. Air atomized liquid coating materials are those which are atomized by impact of an airstream with the liquid material as it is discharged from the nozzle of the gun. Airless atomized liquid coating materials are those which are atomized as a result of being forced through a very small orifice at a very high pressure. All of these coating materials, i.e., air atomized liquids, airless atomized liquids, and air-entrained solid particulate materials, require that they be sprayed from different electrostatic spray guns, all of which, prior to the invention of this application, have required different barrel configurations as well as different handle configurations. The manufacture and inventory of all of these different varieties of electrostatic spray guns is very expensive. It has therefore been an objective of this invention to provide an improved electrostatic spray gun which is capable of spraying all of these different types of coating materials with a minimum of different electrostatic spray gun components. To accomplish that end, the invention of this application utilizes a common handle and htree different barrels, each barrel of which is capable of spraying one of an airless liquid spray or an air atomized liquid spray, or an air-entrained solid particulate material. By utilizing a common handle for all three different types of guns, the manufacturing costs and inventory requirements for the three different types of spray guns are substantially reduced.

Location of the power pack within the handle section of the gun in a gun wherein multiple different barrels may be interchangeably attached to the handle section results in a construction wherein a user of multiple different guns will need only on handle and power pack to accomplish spraying of different materials utilizing different spray processes through differeing barrels. Consequently, the cost of the barrels is substantially reduced over what would otherwise be the cost if each barrel contained a portion in all of the power pack.

These and other objects and advantages of this invention will be more readily apparent from the following description of the drawings in which.

Figures 2, 2A:
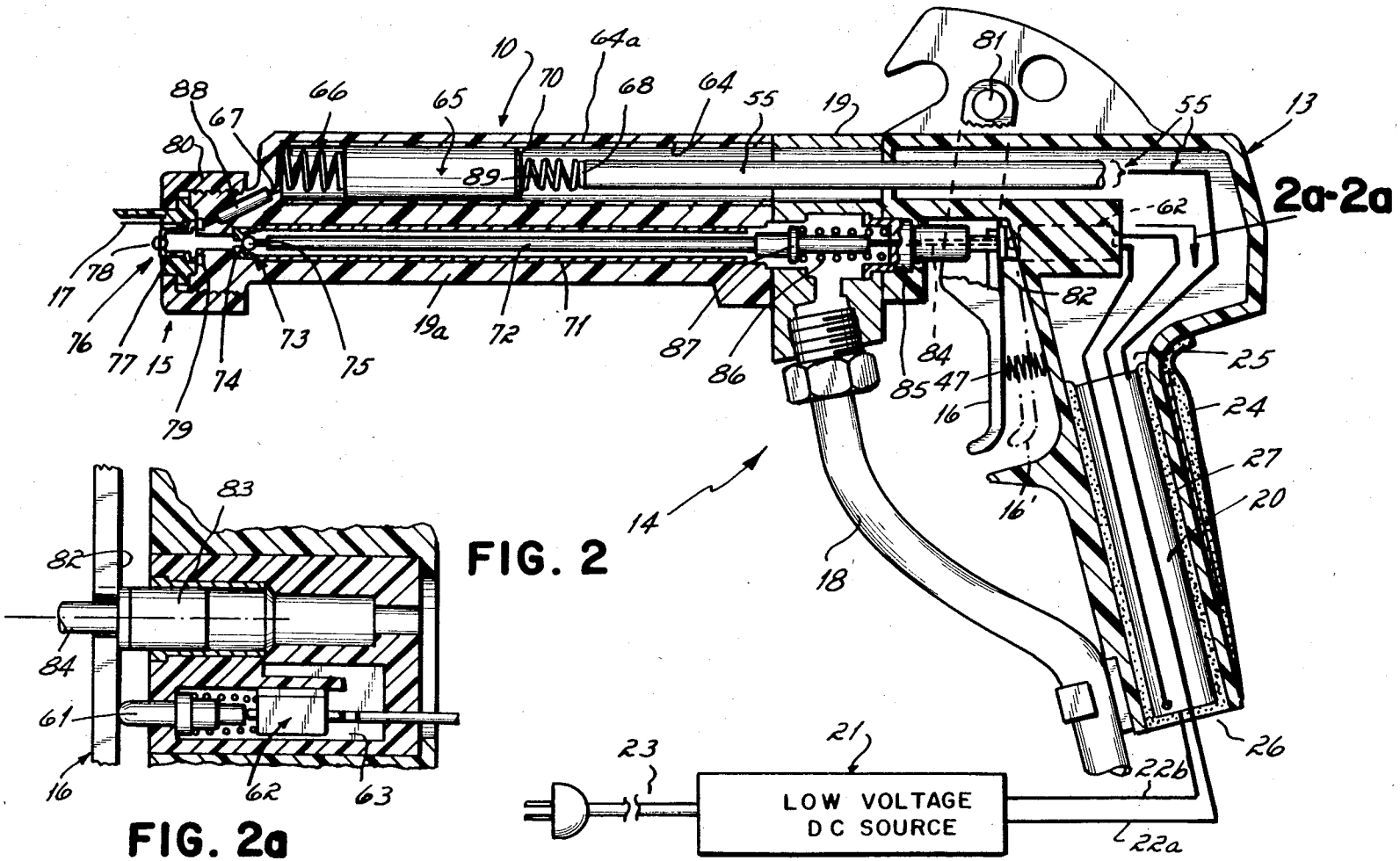
FIG. 2 is a cross-sectional view through the handle and airless liquid spray barrel of FIG. 1.

FIG. 2*a* is a cross-sectional view taken on line 2*a*—2*a* of FIG. 2.

Figure 1:
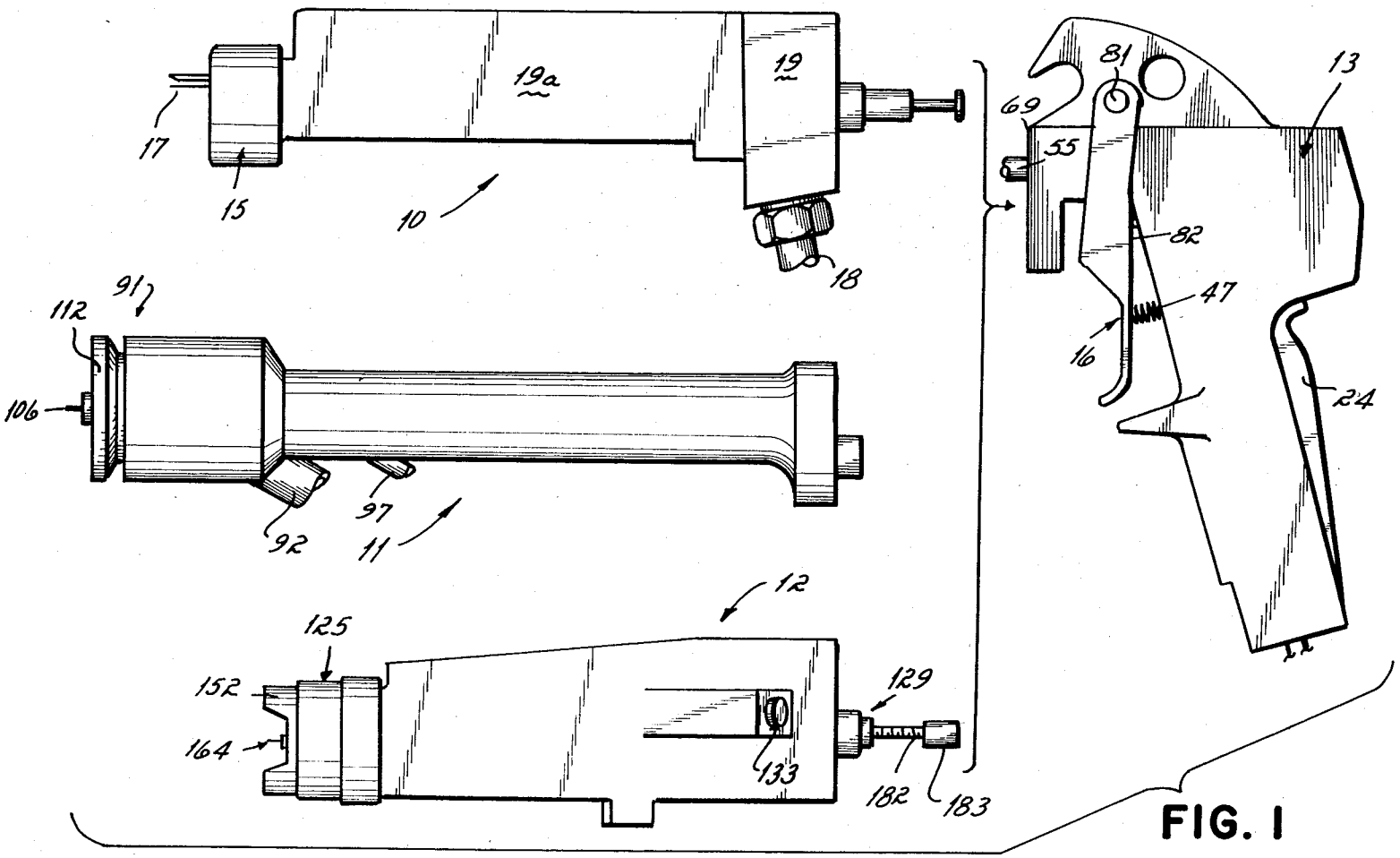
FIG. 1 is a side elevational view of a handle and three different barrels interchangeably usable in combination with the handle in accordance with the practice of the invention of this application.
Figure 3:
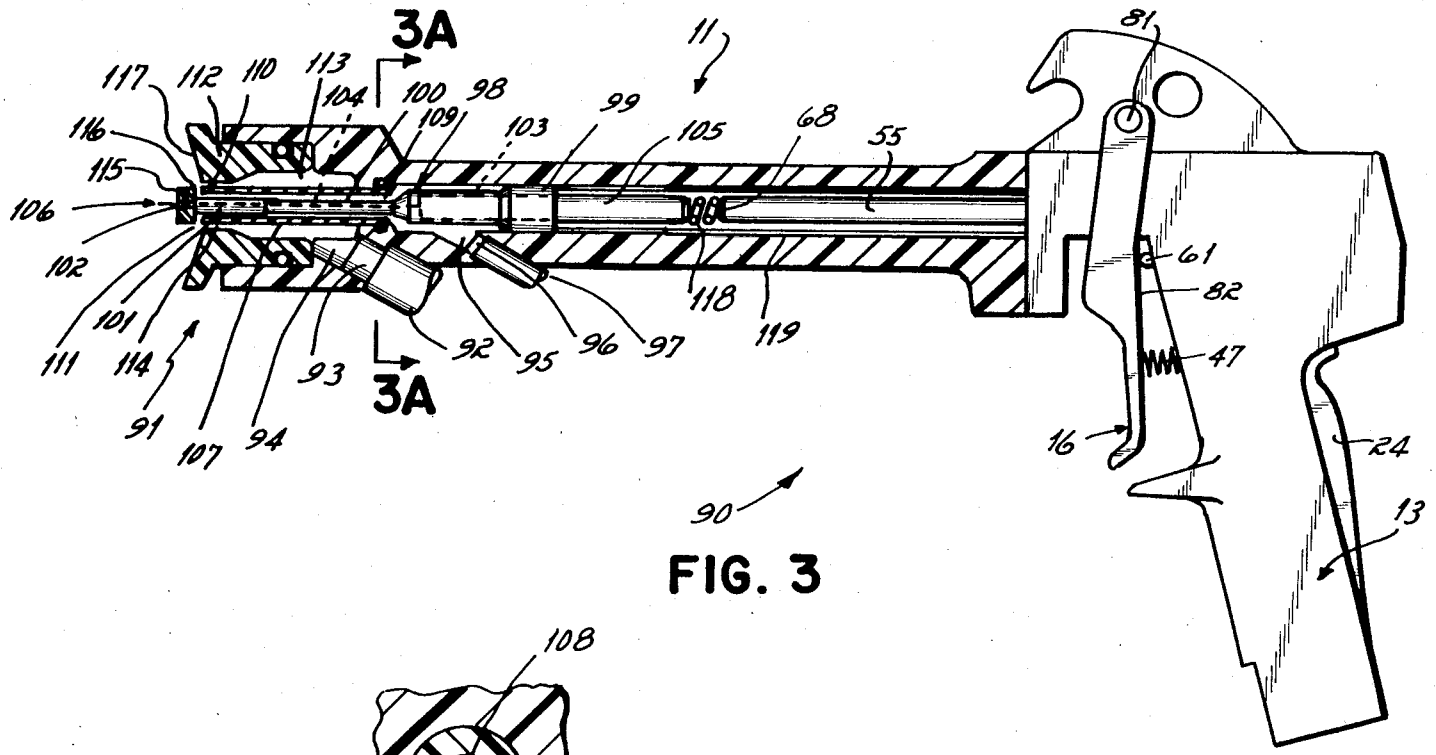

FIG. 3 is a cross-sectional view through the handle and the powder spray barrel of FIG. 1.

Figure 3A:
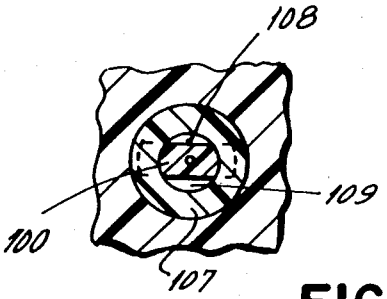

FIG. 3*a* is a cross-sectional view taken on line 3*a*—3*a* of FIG. 3.

Figure 4:
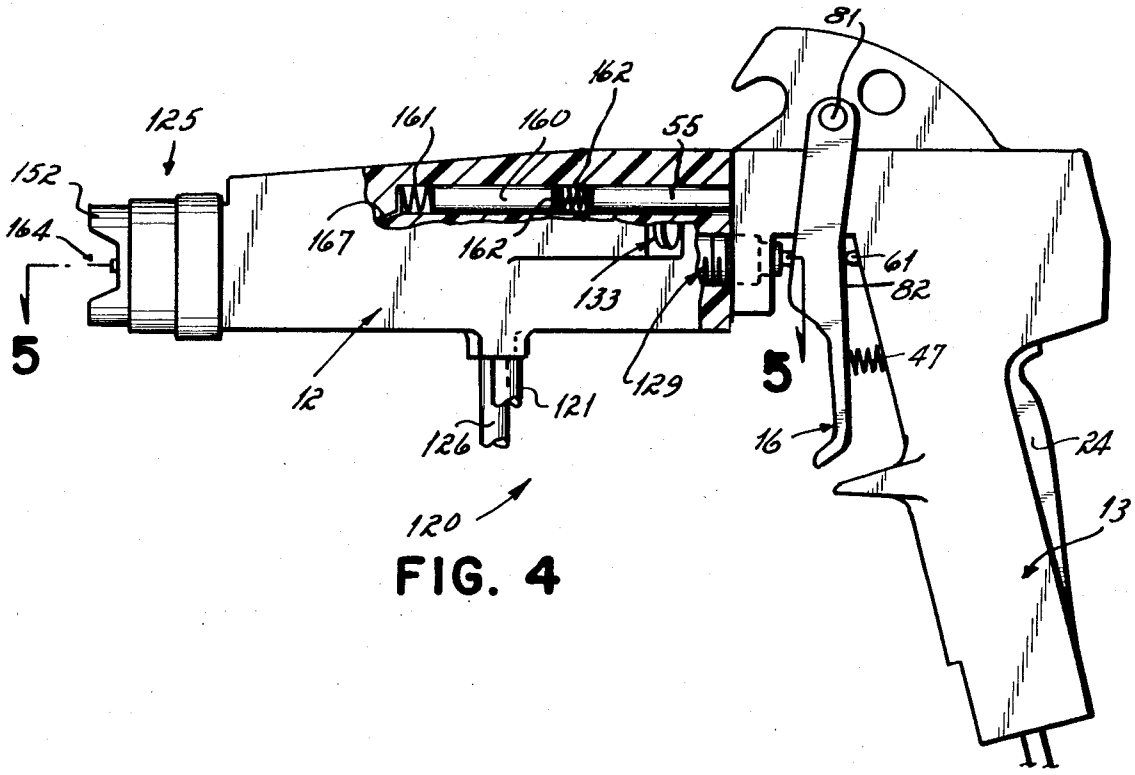

FIG. 4 is a cross-sectional view partially broken away of the handle and air spray barrel of FIG. 1.

Figure 5:
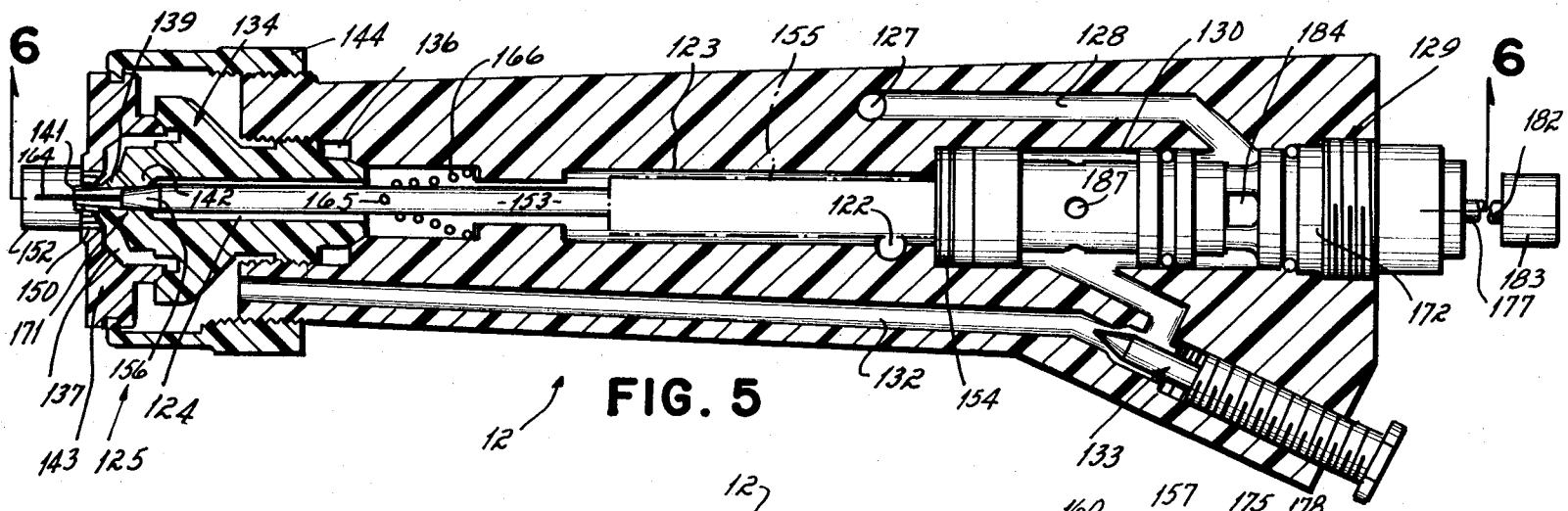

FIG. 5 is a cross-sectional view taken on line 5—5 of FIG. 4.

Figure 6:
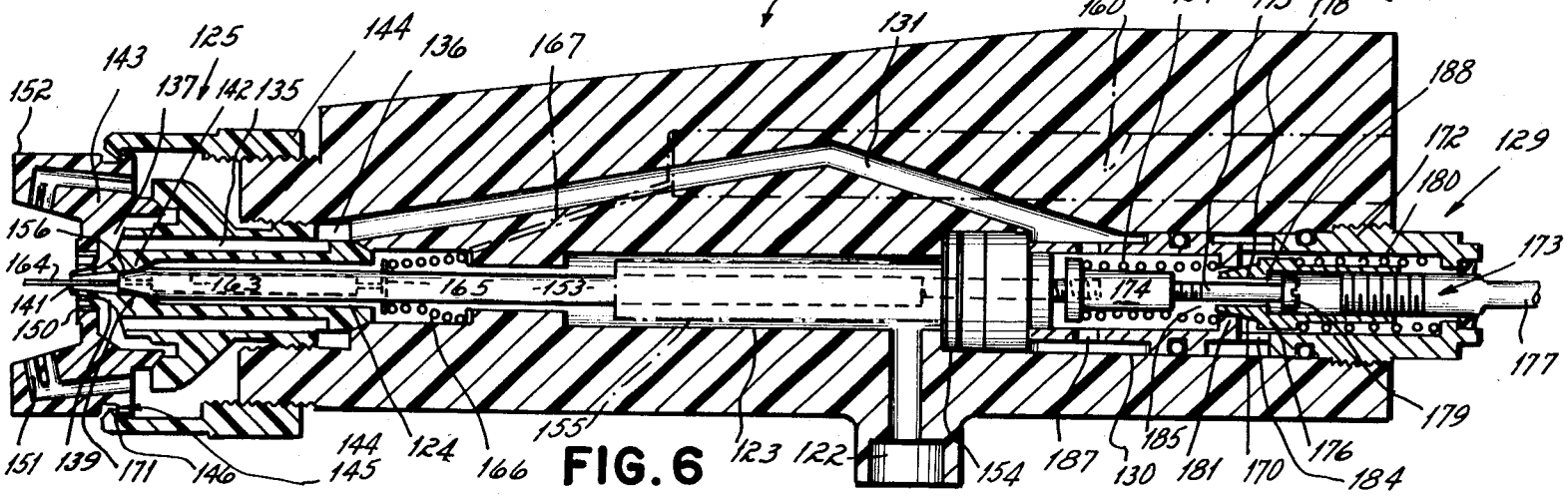

FIG. 6 is a cross-sectional view taken on line 6—6 of FIG. 5.

Figure 7:
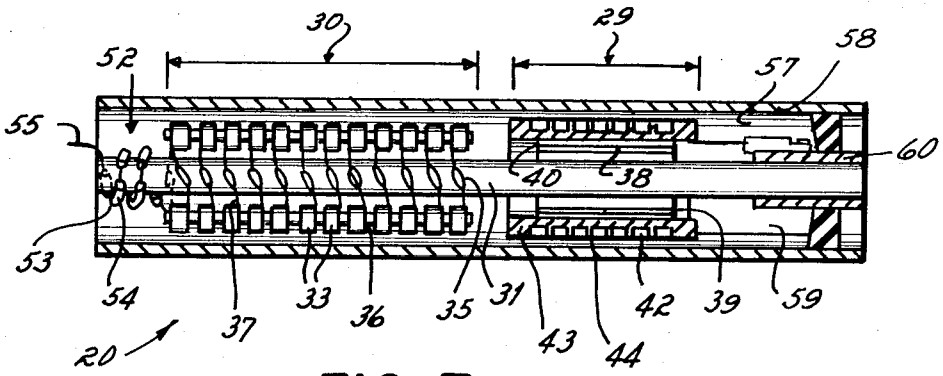

FIG. 7 is a cross-sectional view of the electrical power pack utilized in the handle of the gun according to the practice of this invention.

Figure 8:
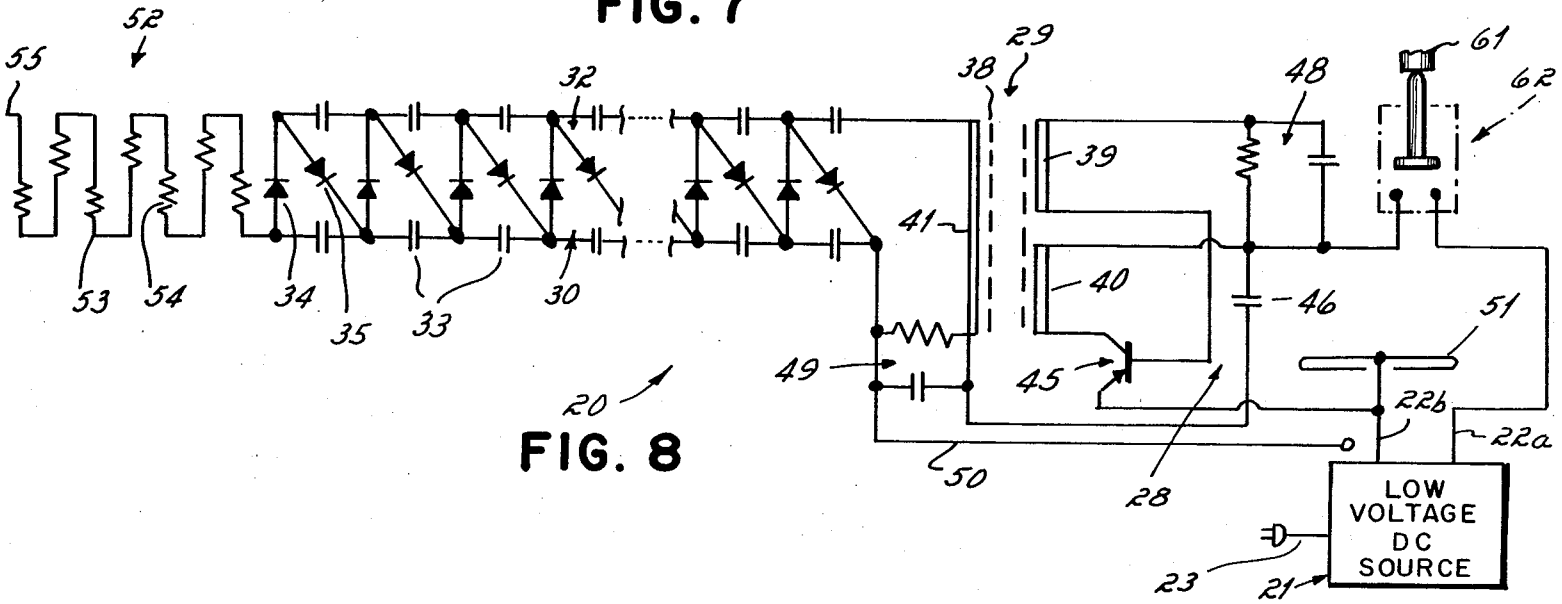

FIG. 8 is an electrical circuit diagram of the power pack of FIG. 7.

According to the invention of this application, three different barrels 10, 11 and 12 are utilized alternatively with a single common handle 13 to electrostatically spray either liquid or solid powder coating materials from a gun which combines one of these barrels with the handle. Specifically, the barrel 10, when utilized in combination with the handle 13, effects airless atomization of liquid sprayed from the gun. The barrel 12, when utilized in combination with handle 13, effects air atomization of liquid material emitted from the nozzle of the gun. And, the barrel 11, when utilized in combination with the handle 13, sprays air-entrained solid particulate powder from the gun. In all instances, though, the coating material emerging from the composite gun is electrostatically charged.

Airless Spray Gun

Referring first to FIGS. 1 and 2, the airless liquid atomization gun is illustrated. As may be seen in these figures, the airless gun 14 includes the handle 13, designed to be manually grasped by the operator, and the barrel 10 terminating at its forward end in a nozzle 15. A spray of finely divided, or atomized, particles of coating material such as paint, lacquer or the like, flows from the nozzle 15 toward an object to be coated when the gun trigger 16 is activated by the operator. An electrode 17, electrically insulated from the gun handle 13, trigger 16, and barrel 10, is mounted in the nozzle 15 and maintained at a high DC potential, either positive or negative, for charging the coating particles in the spray as the particles leave the nozzle 15. Charging of the coating particles enhances, for reasons well-known in the art, the deposition of the coating particles on a target article being coated which is maintained at an electrical potential different from that of the electrode 17, such as ground potential.

A source of coating material is connected via a suitable fluid conduit 18 to the barrel 10 of the gun. A pump (not shown) is connected in line 18 between the source of coating material and the gun barrel 10. This pump is operative to pressurize the coating material so as to facilitate atomization of the coating material by the nozzle 15 as in conventional in the airless spray technique.

An electrical powre pack or booster supply 20 is housed within the gun handle 13 for supplying a high DC voltage, for example 76 kv, to the electrode 17 from a low voltage DC source 21, for example, an 11 volt DC supply. The low voltage source 21 is connected to the gun handle 13 via a low voltage line 22. For convenience, the low voltage DC source 21 connects via line 23 to a conventional 120 volt, 60 Hz AC source.

The handle 13 preferably is molded of electrically non-conductive material, such as polyphenylenesulfide, and is provided with an internal cavity 25 which houses certain of the operating components of the electrostatic spray gun system, including the electrical power pack or booster supply 20. The cavity 25 is open at its lower end 26 to permit introduction of the low voltage line 22 into the interior of the gun. A palm pad 24 of electrically conductive plastic is provided in the rear of the handle. The pad 24 is grounded through a conventional handle grounding circuit so as to protect an operator against electrical shock.

The voltage booster or power pack 20 is generally cylindrical in configuration and is configured so as to fit within a bore 27 of the handl 13. The power pack 20 is potted within the bore 27 so as to be permanently fixed therein. Except for its configuration so as to fit within the handle 13, this power pack is known to the prior art and per se forms no part of the invention of this application. This application contains a complete description of the power pack 20 only because applicant has been unable to locate a published English language description of this power pack.

The components of the voltage booster 20 comprise a transistor-oscillator circuit 28, a transformer 29, and a voltage multiplier 30 connected one behind the other and arranged as shown in FIGS. 7 and 8 around a central acetyl resin core 31. In a preferred embodiment of this core 31, it is made of "Delrin" plastic.

The voltage multiplier 30 is designed according to FIG. 8 as a cascade circuit 32 which consists of two rows of capacitors 33 connected in a series and rectifier diode components 34, 35 inserted in each case between the rows with alternating forward directions. The forward direction of diode components 34 extends from the first to the second row of capacitors, and the forward direction of diode components 35 extends in the opposite manner from the second row to the first row of capacitors. The diode components 34, 35 are in each case connected in pairs to the connections of the capacitor rows, i.e., on one row of capacitors, each pair of diodes is connected to the same capacitor connection, whereas on the other row of capacitors, the two diodes of each pair are connected to connections which are adjacent to each other on either side of one of the capacitors 33 of that row. Capacitors 33 of each row of capacitors are designed as shown in FIG. 7 as circular components, which are stacked on top of each other to form self-supporting capacitor columns 36 with the intermediate insertion of one connecting point in each case for the diode components 34, 35. The capacitor columns 36 extend in each case along the central core 31 and are diametrically opposite each other across this core. The diode components 34, 35 are divided into two groups of diodes, of which one has the diode component 34 of one forward direction, while the other diode group has diode components 35 of the other forward direction. On the central core 31 between the two columns 36 of capacitors 33, there is the one diode group on one side of the central core 31, while the other diode group is arranged on the other side of the core, so that the diode groups are also diametrically opposite each other across the core 31 but shifted by 90° with respect to the capacitor columns 36. The connections of the capacitor columns 36 have in each case two ends, one on each side of the column to which the leads 37 of the adjacent diode groups in each case are soldered. The diode groups and the capacitor columns thus form together a tubular assembly forming a closed periphery in itself, which therefore is relatively stiff dimensionally, which surrounds concentrically the central core 31, and which contains on either side of the capacitor columns 36 only the diode components 34 or 35 arranged by forward direction and orientation. In this way, the voltage multiplier 30 has both a compact and a clear design, so that it can operate with low losses and low interference, and can be produced so as to occupy a small space while providing a high level of performance, which facilitates its installation in the handle 13 of the gun.

The transformer 29 connected as shown in FIG. 8 to the input of the voltage multiplier 30 according to FIG. 7 also has a tubular design and surrounds the central core 31 adjacent to the input end of the multiplier 30. The transformer 29 accordingly has a tubular ferrite core 38, on which the feedback winding 39 is wound with uniform spacings of the turns over most of the length of the core, so that with the least possible number of turns the most uniform possible magnetization of the transformer core 38 is obtained, and on which next to the primary winding 40 the feedback winding 39 for the operation of the oscillator circuit 28 in FIG. 8 is wound. The secondary winding 41 of the transformer 29 is formed in the manner shown in FIG. 7 as a chamber coil 42, which contains a coil element 43 cylindrically surrounding the primary winding 40 and the feedback winding 39, in the outer periphery of which element several adjacent annular chambers 44 are provided, in which the wire windings of the secondary winding are situtated. In this way, the distributed capacitance of the transformer 29 is kept to a minimum, so that it can be operated at a higher frequency, and therefore the capacitors 33 of the voltage multiplier 30 can have a correspondingly smaller capacitance and therefore a smaller size with a correspondingly lighter weight.

On the side of the transformer 29 facing away from the voltage multiplier 30 is the oscillator circuit 28. The oscillator circuit 28 forms a power oscillator in which, as shown in FIG. 8, a transistor 45 with its collector-emitter branch, is inserted in an oscillating circuit consisting of the primary winding 40 of the transformer 29 and an electrolyte capacitor 46 connected in parallel to it, which is connected by way of the positive and the negative connections to the external DC source 21. The base of the transistor 45 is connected to one end of the feedback winding 39, whose other end is wired by way of a parallel circuit 48 consisting of a resistor and a capacitor to the positive terminal of the power source 21, to the negative terminal of which the emitter of the transistor 45 and the one end of the secondary winding 41 of the transformer 29 are connected, which is connected by way of a parallel circuit 49 consisting of a resistor and a capacitor to the one input of the voltage amplifier 30, to a reference line 50 extending out from it, and to an electric shock safety device 51 shown schematically in FIG. 8 on the gun handle to ground it.

A current-limiting resistor 52 is also included in the power pack 20 and is located between the high voltage output of the voltage multiplier 30 and the power pack output lead 55. This current-limiting resistor 52 is in the form of a resistor chain 53 consisting of several resistor components 54 connected in series which are wound around the core 31 between the output end of the voltage multiplier 30 and the lead 55 to the resistor 56 contained in the barrel of the gun. The resistor chain 53, the voltage amplifier 30, the transformer 29, and the oscillator circuit 28 are cast in resin 57 in the space between the core 31 and a jacket tube 58, this resin having in addition to satisfactory electrical insulating properties the greatest possible thermal conductivity for removing the heat generated during the operation of the high voltage generator. The fastening bracket 59 on which, in addition to the components of the oscillator circuit 28, the components of the parallel circuit 49 in FIG. 8 are also arranged, consists of a metal with good thermal conductivity and is in thermally conductive contact with a metal tube 60 which is attached to the end of the central core 31. The fastening bracket 59 and the metal tube 60 thus form a heat-removing component which serves to conduct away the heat generated in the high voltage generator to the gun handle.

A microswitch 62 is inserted in the line **22*a* leading to the positive terminal of the external DC power source 21; this switch is housed in a bore 63 of the handle and is actuated by a plunger 61 associated with the trigger of the gun handle. The plunger 61 is spring biased to an open position of the switch 62** as in conventional in electrostatic spray guns.

The power pack shown in FIGS. 7 and 8 thus forms an electrostatic accessory unit which, due to the design of the high voltage generator housed within it, can be coupled comparatively easily and manageably to the electrode of an electrostatic spray gun and may be easily mounted within the handle of the gun.

In a preferred embodiment, the external DC source 21 is designed in the form of a line device for a voltage of 12 V; the oscillator 28 is designed for a frequency of 20 kHz with an output voltage of 10 $kV_{ss}$, whereas the voltage multiplier 30 has twelve stages and a negative high voltage of 90 kv with an output power of 3.6 W. The current-limiting resistor 52 inserted between the output of the voltage multiplier 30 and the output lead 55 has a total resistance of about 100 megohms, so that the current is limited to 1 megohm. The maximum thermal conductivity of the casting resin 57 and/or of the supply tube 60 for improving the removal of the heat generated in the high voltage generator can be achieved in particular by the incorporation of a filler with high thermal conductivity such as quartz flour, kaolin, or mica.

The barrel 10, which is detachably mounted to the handle section 13 of the gun by conventional threaded connectors or bolts (not shown), preferably is fabricated in two pieces; a metal extrusion head 19, and a plastic barrel section **19*a* of a tough, electrically insulative material. The barrel is made in two pieces so as to enable the high pressure fittings of hose 18 to be connected to the metal extension head 19. The two piece barrel 10 is provided with a first cavity 64 adapted to accommodate a primary electrical resistor 65. This resistor 65 is connected at one end via a conventional spring and washer connection 66, a lead 67, and a small secondary resistor 88 to the electrode 17. At its opposite end, the primary resistor 65 is removably connected by a spring 89 and cable 55 to the power pack 20. To this end, the cable or lead 55 extends from the handle 13 and is adapted to be received within the bore 64 of the barrel 10. A contact 70 of resistor 65 is maintained in electrical conctact with the end 68 of the cable 55 by the spring 89. A dielectric sleeve 64*a* surrounds the resistor 65 and cable 55 within the bore 64. A second cavity 71 is also provided in barrel 10. This cavity constitutes a coating flow passage interconnecting the conduit 18 and the atomizing nozzle 15. Cavity 71 additionally houses a longitudinally reciprocable actuating rod 72 which responds to the trigger 16 for opening and closing a flow valve 73 comprising seat 74 and ball 75. Valve 73 regulates the flow of coating material from the cavity 71 to the atomizing nozzle 15**.

The atomizing nozzle 15 includes a conventional orifice assembly 76 preferably constructed of a metal member 77 having a carbide insert 78 in which an orifice (not shown) is acutally formed. Member 77 is secured to a generally ring-shaped mounting structure 79 of insulative material. The orifice-mounting ring 79 is maintained in operative position relative to the coating flow passage 71 by an insulative retaining ring 80 which is threaded to the front of the barrel 10.

The electrode 17 is preferably configured in the form of a needle, the inner end of which is in electrical contact with the output terminal of the resistor 55 via an electrical conductor 67.

The trigger 16 is suitably pivotally connected at its upper end to to the gun handle 13 as shown at 81 for movement between an outer inactive position shown in solid in FIG. 2 and an inner active position shown in phantom at 16'. The trigger is biased to the inactive position by a spring 47. When the trigger is moved to the active position 16', a rear surface 82 of the trigger contacts the plunger 61 and actuates a microswitch 62 to energize the power pack 20. In addition to actuating the switch 62 when the trigger 16 is moved to its active position 16', movement of the trigger also opens the flow valve 73 to permit the flow of pressurized coating material from the line 18 through the passage 71 to the orifice assembly 76 whereat energization takes place. Specifically, movement of the trigger 16 to its active position 16' rearwardly reciprocates a guide 83 on the end of an extension 84 of rod 72. The rod extension 84 slides in an axial bore formed in a seal member 85, moves the rod 72 rearwardly, in turn unseating the ball 75 from seat 74 to open the flow valve 73. A comprssion coil spring 86 sandwiched between the seal member 85 and the circular shoulder 87 formed on the rod 72 biases the rod 72 and hence the ball valve 74 to a closed position.

The sequencing of the switch 62 and the valve 73 is such that the switch 62 closes either simultaneously with of just immediately prior to the opening of the valve 73. Consequently, any liquid emitted from the orifice assembly 76 is atomized in the course of passage from the nozzle and is electrostatically charged as a result of passing through the elecrostatic field created by the electrode 17.

The airless spray gun 14 created by the barrel 10 and handle 13 is operable to atomize liquid supplied from a high pressure source to the conduit 18 in the same manner as prior art airless spray guns. The gun 14 differs from conventional prior art airless spray guns such as that disclosed in U.S. Pat. No. 3,731,145 principally in that the complete power pack is contained in the handle 13 of the gun and in that the handle and barrel 10 are so configured as to be separable and detachable so as to enable other barrels to be interchanged for the barrel 10 as best illustrated in FIG. 1.

Powder Spray Gun

Referring now to FIG. 3, the same handle 13 is illustrated as applied to a powder spray barrel 11. With this combination of powder spray barrel 11 and electrostatic power pack containing handle 13, the resulting gun 90 may be used to spray air-entrained solid particulate powder material. Since the complete handle 13 of a powder spray gun 80 is identical to the handle 13 utilized in the airless spray gun 14, the components of the handle 13 in the gun 80 have been given identical numeral designations in this gun 90 as in the gun 14.

The gun 90 is an air-operated electrostatic powder spray gun which employs the impact of a pressured airstream with a stream of fluidized coating material to effect spraying of the solid particulate powder material and formation of the material into a desired conical spray pattern. The gun comprises the power pack containing handle 13 and an electrically insulative barrel assembly 11 with an electrically insulative nozzle assembly 91 at the forward end of the barrel 11. Powder coating material is supplied to the gun under pressure from an external reservoir or tank through a hose 92. The hose 92 is adapted to connect it to a fitting 93 mounted in an opening 94 through the wall of the barrel 11 of the gun. The powder coating material is fluidized by a pressurized gas such as air and is conveyed through the hose 92 to the gun under pressure. The barrel 11 includes a second opening 95 extending through the wall thereof in which there is mounted a fitting 96 through which an air hose 97 with pressurized air is adapted to be attached.

The nozzle assembly 91 includes a tubular support member 98 formed of an electrically insulative material. The support tube 98 is supported at its rearward end 99 in the barrel 11 of the gun 90 and has at its front end a small diameter portion 100, a larger diameter portion 101 and a small diameter forwardmost portion 102 all extending forwardly of the rearward end 99. The rearward end 99 includes an internal cavity 103 and an opening 104 extends down the center of the forwardly-extending portions 100, 101, 102, the axis of which lies on the center axis of the barrel 11. A resistor 105 slides into the tubular cavity 103 in the rear end 99 of the tube 98, and a charging electrode 106 extends through the opening 104 and out of the forwardmost end 102.

A tubular sleeve 107 slides on the small diameter portion 100 of the tube 98 and is supported thereby. As may be seen by referring to FIG. 3A, the section 100 of the support tube 98 is provided with a pair of flats 108 on two sides thereof to permit the flow of pressurized air along the sleeve 107 through a passageway 109 defined by the sleeve and the flattened portions 108 and the larger diameter portion 101 of the support tube 98. As may be seen, this passageway extends along the center of the barrel and nozzle assembly and terminates at an open forward end 110 in the form of an annular gas flow passage 111. The sleeve 107 slides into the barrel at its rearward end, and an O-ring seal is provided between the outer surface of the sleeve 107 and the barrel 11 to prevent leakage of pressurized air entering the barrel 11 through the opening 95 in the wall thereof along the outside of the sleeve. In this manner, pressurized air entering the barrel through the opening 95 is directed through the passageway 109 and out the open end 110 to the sleeve 107 in thr form of an annular stream of gas under pressure.

A nozzle 112 is mounted in the forward open end of the barrel 11. This nozzle includes a central through opening 113 through which the forward end 110 of the sleeve 107 passes. The inner surface of the nozzle 112 defines with the outer surface of the sleeve 107, an annular passageway 114 through which fluidized powder coating material entering the nozzle assembly 1 through the opening 94 in the wall of the barrel is emitted from the nozzle. The powder coating material is emitted from the nozzle 58 in the form of an annular flow of material encircling the pressurized air flowing out passageway 111 at the center of the nozzle assembly.

A gas deflector cap 115 is mounted on the forwardmost end 102 of the support tube 98 and is displaced slightly forwardly of the forward open end 110 of the sleeve 107. The deflector cap includes a surface 116 against which the annular stream of pressurized air issuing out of the open end 110 of the sleeve 107 impacts. The deflecting surface 116 changes the direction of this stream of flowing air from one being axially directed along the center of the nozzle assembly to one which is radially directed outwardly in a 360° pattern. The pressurized air enters the gun through the opening 95 in the wall of the barrel 11 and is directed through the passageway 109 and out the annular opening 111 in the open end 110 of the sleeve 107. The pressurized air issuing out of the open end 110 impacts the surface 116 of the deflector cap 115 and is thereby turned 90° to a radial outward direction. The coating material enters the nozzle assembly through the openign 94 in the wall of the barrel 11 and flows along the outside of the sleeve 107 and out the annular opening 114. When the coating material which is being conveyed by air under pressure is emitted from the nozzle 112, it is impacted by the outwardly-flowing stream of pressurized air ans is thereby caused to be finely atomized and a uniform, conical pattern of material results from the impact of the radially outwardly-flowing stream of air and the axially flowing stream of powder. The nozzle 112 includes a generally conical surface 117 for directing the outwardly and forwardly-moving conical spray of material. The atomized powder is electrically charged by the electrode 106 extending out of the nozzle assembly 91 and past the air deflector cap 115.

A spring 118 is sandwiched between resistor 105 and a contact 68 on the end of the cable 55. This spring maintains electrical contact between the cable 55 of the handle and the resistor 105 contained in the barrel 11. A dielectric sleeve 119 encloses the resistor 105, cable 55 and their contacts.

In the operation of the gun 90, the handle is triggered rearwardly by an operator of the gun so as to close the switch 62. Closing of this switch is operative to cause low voltage DC power to be connected to the power pack 20 so as to charge the electrode 106. Simultaneously, this switch is operative through appropriate controls to open the powder hose 92 and air hoses 97 to their respectively supply sources so as to result in powder being supplied to opening 94 and air under pressure being supplied to the opening 95.

The powder spray gun 90 is generally conventional in operation except that the complete power pack of the gun is contained in the handle 13 and the barrel 11 of the gun is detachably connected thereto so that it may be removed and interchanged with the barrels 10 and 12. In all other respects, the powder spray gun 80 is substantially identical to conventional powder spray guns, such as the gun disclosed in Hollstein U.S. Pat. No. 4,380,320, assigned to the assignee of this application.

Air Atomizing Gun

With reference now to FIGS. 4, 5 and 6, there is illustrated the handle 13 in combination with the air atomizing liquid spray gun barrel 12. This gun 120 relies upon the impact of an airstream with the liquid stream to effect atomization of the liquid stream.

The gun 120 comprises the previously described handle 13 and an electrically insulative barrel assembly 12. Paint or liquid spray coating material is sprayed from the gun under pressure from an external source (not shown) supplied to the gun via a hydraulic hose 121.

The hose 121 is connected to an inlet passage 122 in the bottom of the barrel 12. The inlet passage 122 communicates with an annular axial fluid flow passageway 123 in the barrel 12. The passageway 123 in turn communicates at its forward end with a central annular axial passage 124 in the nozzle assembly 125. The passages 123, 124 are substantially axially aligned.

An air hose 126 is connected to an air passage 127 and communicates through an air flow passage 128 of the barrel with an air valve 129 located within the interior of the barrel. Specifically, the valve 129 is mounted within a large continuation 130 of the passage 123. This valve 129 is operative to control the flow of atomizing air via passage 131 to the nozzle assembly 125 and the flow of fan-shaping pattern or so-called "horn air" to the nozzle 125 via an internal flow passage 132. The flow passage 132 contains a needle valve 133 for controlling the quantity of fan-shaping air supplied to the nozzle assembly upon opening of the air control valve 129.

The nozzle assembly is made of an electrically nonconductive material. The nozzle 125 has a fluid tip 134 which is threaded at its rear into a counterbore in the forward end of the barrel 12. The fluid tip 134 has a number of circumferentially-spaced axial passages 135 which open at their rear into the counterbore to communicate with an annular air passage 136 such that atomizing air passing through the passage 151 into the passage 136 may enter and pass through the axial passages 135 in the fluid tip and into an internal chamber 137 surrounding the forward end of the fluid tip. The fluid tip also includes the central axial passage 124 communicating with the material flow passageway 123 in the barrel portion of the gun for supply of paint via the hose 121 from the tank or reservoir.

The forward end of the fluid tip 134 terminates in a nozzle 139 having a small diameter orifice 141 through which the coating material is emitted. The fluid tip 134 further includes a coned seat 142 formed inside the nozzle 139 close to the discharge orifice 141.

An air cap 143 surrounds the forward end of the fluid tip 134. The air cap is mounted to the gun by means of an annular retaining ring 148 which is thread over a threaded section of the barrel 12 at one end and at its other end there is an annular lip 145. The retaining ring 148, although rigid, is sufficiently flexible at the lip 145 to permit the air cap to be snappd into position with the lip 145 engaging a wall 146 in an annular groove 147 in the outside surface of the air cap 143 such that the air cap is securely retained and sealed against the escape of air to the atmosphere.

Flow of the atomizing air is through the openings 150 close to the nozzle 139, and flow of the fan-shaping air is through openings 151 in the opposed air horns 156.

The flow of paint through the axial flow passageways 123 and 124 is controlled by a control rod 153. the control rod is mounted at its rear in the valve assembly 129, the rod being sealed by packing 154 and a flexible bellows seal 155 such that the control rod 153 is axially slidable in a forward and rearward direction upon operation of the trigger 16.

The control rod 153 terminates at its forward end in a cone-shaped tip 156. The coned tip cooperates with the internal seat 142 in the fluid nozzle 139 to form a needle and seat valve assembly actuatable by the trigger 16. That is, when the trigger 16 is pulled rearwardly, the rod 153 is retracted which retracts the cone-shaped tip 156 of the rod from the valve seat 142 immediately behind the material discharge orifice 141 allowing the pain in the passageway 124 to flow around the tip 156 and out the discharge orifice 141. When the trigger is released, a spring 157 in valve 129 moves the contol rod 153 forwardly with the tip engaging the valve seat to thereby stop the flow of paint.

A resistor 160 is mounted in the barrel 12 of the gun between a first spring 161 and a second spring 162 which acts as a contactor with the contact 68 on the end of the cable 55 extending from the handle 13. Alternatively, resistor 160 could be integrally mounted at the end of cable 55, with spring 162 extending from the resistor 160 to make electrical contact with lead 167, and with spring 161 being eliminated in this embodiment. This alternative embodiment could be used with extensions 10 and 11 as well. The resistor 160 is thus in series with the electrical power pack 20 contained in the handle 13 of the gun. Within the forward end of the control rod 153 is a second resistor 163. The forward end of the resistor 163 is electrically connected to a thin, stainless steel wire electrode 164 extending through the discharge orifice 141 of the fluid nozzle 139. This electrode 164 ionizes the atomized paint emitted from the nozzle assembly 125.

The rear end of the resistor 163 is in contct with the metallic pin 165 passing through the rod 153. The pin 165 in turn is in contact with the conical spring 166 contacting an electrical lead 167. This lead 167 is connected via spring 161 to resistor 160 and hence the power pack 20, as described above.

Accordingly, the conical spring 166 and pin 165 cooperate to form means electrically connecting the conductor 167 with the resistor 163 while permitting axial sliding movement of the actuating rod 153 to open and close the vlave. The path of high voltage electrical energy from the resistor 160 is thus through the electrical lead 167, the conical spring 166, the pin 165, and the resistor 163 to the ionizing electrode 164. The resistor 163 thus lies in series in the high energy electrical path and lies forwardly or "downstream" of all the conductive components of the gun other than the ionizing electrode 164.

The air valve 129 controls not only the supply of atomizd air and fan-shaping pattern air to the nozzle 125, but also controls the sequencing of that air supply with the liquid supply to the nozzle assembly. Specifically, this air control valve 129 is operative to first open air valve 170 contained internally of the valve 129 and then after atomizing air and fan-shaping air are being supplied to the nozzle assembly 125, to then permit the opening of the liquid valve 171 so that liquid is ejected from the nozzle assembly.

The air valve 129 comprises a valve body 172 through which there passes a four-piece air valve stem 173. This valve stem 173 comprises an end section 174, a screw section 175, a valve section 176, and an actuation section 177. The end section 174 is threadedly connected to the stem 153 of the liquid flow control valve and is sealingly separated therefrom by an end section 178 and packing 154 of the valve body.

The screw section 175 of the valve stem is threaded into the end section 164 of the stem 173 and slidingly passes through a bore 178 of the valve section 176. The threaded screw section 175 terminates in a slotted head 179 which acts as a stop to limit the travel of the valve section 178 relative to the screw section 175. The valve section is in turn provided with an axial bore into which the atuating section 177 of the valve stem is threaded. There is a spring 157 contained internally of the valve for biasing the end section 174 and thus the attached valve stem 153 of the liquid flow control valve 171 to a closed position. There is also a second spring 180 contained internally of th air valve for biasing the air valve 170 to a closed position relative to its seat 181.

The end 182 of th air valve actuating stem 177 is threaded and has a threaded collar 183 mounted thereon. This collar 183 is adapted to be engaged by surface 82 of the trigger 16 so that upon rearward movement of the trigger about the pivot 81, the actuating section 177 of the air valve 170 will be pulled rearwardly. This results in opening of the air valve 170 so that high pressure air contained in the passage 128 may flow through ports 184 in the valve body 172 to the internal flow chamber 185 of the valve body. This high pressure air then flows from chamber 185 through valve 170 and via ports 187 to the air atomizing passage 131 and needle valve 133 to the air fan-shaping passage 132. After the air valve 170 has moved rearwardly a predetermined and adjustable distance, a shoulder 188 of the valve section 176 engages the slotted head 179 at the end of the adjustment screw section 175 of the valve stem so that continued movement of the trigger 16 results in axial movement of the valve stem 153 and thus the liquid control valve 171. Upon opening of the liquid control valve, liquid is emitted from gun. Since the air flow valve 170 had been open prior to opening the liquid flow control valve 171, liquid emerging from the nozzle of the gun is impacted by atomized air from the chamber 137 and fan-shaping pattern air from the horn passages 151 of the nozzle assembly 125.

In the course of the trigger 16 moving rearwardly, the switch 62 contained in the handle section 13 of the gun 120 is actuated. As in the previous embodiments, this switch is operative through appropriate controls to cause high voltage electrical power to be supplied from the power pack 20 to the electrode 164 of the gun. As a consequence of this electrode being energized, liquid emerging from the gun is charged with an electrical charge from the electrode.

The primary advantage of the multiple guns described hereinabove is that they all utilize a common novel handle wherein the complete electrical power pack is controlled. All three guns utilize interchangeable barrels. As a consequence, the manufacturer of such guns may substantially reduce its inventory by having only a single handle assembly for all three different styles of guns or, alternatively, a customer for such guns may substantially reduce his equipment costs by being able to utilize a single handle with three different interchangeable barrels, each of which is capable of spraying differing materials and generating different spray patterns.

While I have described only one preferred embodiment of my invention, persons skilled in this art will appreciate the numerous changes and modifications which may be made without departing from the spirit of my invention. Therefore, I do not intend to be limited except by the scope of the following appended claims.

I claim:

1. An electrostatic spray gun comprising:

a handle section, a trigger pivotally mounted upon said handle section, a booster power supply contained solely in said handle section, said booster power supply being operable to convert low voltage electrical energy supplied to said handle section of said gun into high voltage electrical energy, a first barrel section, a flow control valve in said first barrel section, said first barrel section including an electrode mounted thereon, said first barrel section including means for removably securing said first barrel section to said handle section, said first barrel section having first connector means for electrically connecting said electrode of said first barrel section to said booster power supply, and second connector means for connecting said flow control valve to said trigger of said handle section, said first barrel section further including means for attaching said first barrel section to a source of air and to a source of liquid so as to enable said gun to spray an electrostatically charged, air atomized liquid therefrom, a second barrel section, a flow control valve in said second barrel section, said section barrel section including an electrode mounted thereon, said second barrel section including means for removably securing said second barrel section to said handle section, said second barrel section including first connector means for electrically connecting said electrode of said second barrel section to said booster power supply, and second connector means for connecting said flow control valve of said second barrel section to said trigger of said handle section, said second barrel section further including means for attaching said second barrels section to a source of high pressure liquid so as to enable said gun to spray an electrostatically charged, airless atomized liquid therefrom, a third barrel section, said third barrel section including an electrode mounted thereon, said third barrel section including means for removably securing said third barrel section to said handle section, said third barrel section having connector means thereon for electrically connecting said electrode of said third barrel section to said booster power supply in said handle section, said third barrel section further including means for attaching said third barrel section to a source of air entrained powder so as to enable said gun to spray an electrostatically charged air entrained powder therefrom, and said first barrel section, second barrel section, and third barrel section being selectively and alternatively attachable to said handle section to enable said gun to alternatively spray air atomized liquid coating material, airless atomized liquid coating material, and air entrained solid particulate coating material, respectively.

2. The electrostatic spray gun of claim 1 which further includes electrical contact means on said handle section and on each of said first, second and third barrel sections for automatically establishing electrical contact between said booster power supply and said electrodes of said first, second and third barrel sections in response to attachment of said first, second and third barrel sections to said handle section.

3. An electrostatic spray gun comprising:

a handle section, a trigger pivotally mounted upon said handle section, a booster power supply contained solely in said handle section, said booster power supply being operable to convert low voltage electrical energy supplied to said handle section of said gun into high voltage electrical energy, a first barrel section, a flow control valve in said first barrel section, said first barrel section including an electrode mounted thereon, said first barrel section including means for removably securing said first barrel section to said handle section, said first barrel section having first connector means for electrically connecting said electrode of said first barrel section to said booster power supply, and second connector means for connecting said flow control valve to said trigger of said handle section, said first barrel section further including means for attaching said first barrel section to a source of air and to a source of liquid so as to enable said gun to spray an electrostatically charged, air atomized liquid therefrom, a second barrel section, a flow control valve in said second barrel section, said second barrel section including an electrode mounted thereon, said second barrel section including means for removably securing said second barrel section to said handle section, said second barrel section including first connector means for electrically connecting said electrode of said second barrel section to said booster power supply, and second connector means for connecting said flow control valve of said second barrel section to said trigger of said handle section, said second barrel section further including means for attaching said second barrel section to a source of high pressure liquid so as to enable said gun to spray an electrostatically charged, airless atomized liquid therefrom, and said first barrel section and second barrel sections being selectively and alternatively attachable to said handle section to enable said gun to alternatively spray air atomized liquid coating material and airless atomized liquid coating material, respectively.

4. The electrostatic spray gun of claim 3 which further includes electrical contact means on said handle section and on each of said first and second barrel sections for automatically establishing electrical contact between said booster power supply and said electrodes of said first and second barrel sections in response to attachment of said first and second barrel sections to said handle section.

* * * * *

UNITED STATES PATENT AND TRADEMARK OFFICE

CERTIFICATE OF CORRECTION

PATENT NO. : 4,598,871

DATED : July 8, 1986

INVENTOR(S) : Ronald J. Hartle

It is certified that error appears in the above-identified patent and that said Letters Patent is hereby corrected as shown below:

Column 2, line 14, "htree" should be -- three --
Column 3, line 34, "powre" should be -- power --
Column 3, line 56, "handl" should be -- handle --
Column 7, lines 10 and 11, "compresssion" should be -- compression --
Column 8, line 31, "thr" should be -- the --
Column 8, line 63, "openign" should be -- opening --
Column 8, line 68, "ans" should be -- and --
Column 9, line 22, "hoses" should be -- hose --
Column 11, line 22, "atomizd" should be -- atomized --
Column 11, line 51, "th" should be -- the --
Column 11, line 53, "th" should be -- the --

Signed and Sealed this

Third Day of February, 1987

*Attest:*

DONALD J. QUIGG

*Attesting Officer*

*Commissioner of Patents and Trademarks*